US005111193A

United States Patent [19]

Huber et al.

[11] Patent Number: 5,111,193

[45] Date of Patent: May 5, 1992

[54] ELECTRONIC DISPLAY ELEMENT FOR ELECTRONIC DISPLAY DEVICE

[75] Inventors: Terrence D. Huber; Duane B. Kutsch, both of Spokane; William J. Seaton, Greenacres; Donald R. Skinfill, Veradale, all of Wash.

[73] Assignee: American On-Premise Advertising Company, Spokane, Wash.

[21] Appl. No.: 533,742

[22] Filed: Jun. 6, 1990 (Under 37 CFR 1.47)

[51] Int. Cl.[5] ..... G08B 5/00

[52] U.S. Cl. ..... 340/783; 340/815.05; 340/815.29

[58] Field of Search ..... 340/764, 783, 815.05, 340/815.29; 40/449, 450, 451, 492

[56] References Cited

U.S. PATENT DOCUMENTS

| | | | |
|---|---|---|---|
| 755,272 | 3/1904 | Burnham . | |
| 1,191,023 | 7/1916 | Naylor . | |
| 3,025,512 | 3/1962 | Bloechl | 340/373 |
| 3,036,300 | 5/1962 | Knight | 340/373 |
| 3,140,553 | 7/1964 | Taylor et al. | 40/28 |
| 3,169,241 | 2/1965 | Aiken | 340/373 |
| 3,186,115 | 6/1965 | Todt et al. | 40/28 |
| 3,210,757 | 10/1965 | Jacob | 340/373 |
| 3,266,033 | 8/1966 | Frohbach | 340/764 X |
| 3,283,427 | 11/1966 | Winrow | 40/28 |
| 3,295,238 | 1/1967 | Winrow | 40/28 |
| 3,303,494 | 2/1967 | Taylor | 340/373 |
| 3,365,824 | 1/1968 | Winrow | 40/28 |
| 3,426,453 | 2/1969 | Dingwall | 35/61 |
| 3,460,276 | 8/1969 | Payne | 35/66 |
| 3,469,258 | 9/1969 | Winrow | 340/373 |
| 3,482,344 | 12/1969 | Holloman | 40/28 |
| 3,486,258 | 12/1969 | Mueller | 40/28 |
| 3,518,664 | 6/1970 | Taylor | 340/373 |
| 3,552,048 | 1/1971 | O'Keefe | 40/28 |

(List continued on next page.)

FOREIGN PATENT DOCUMENTS

| | | |
|---|---|---|
| 355440 | 8/1931 | Canada . |
| 641350 | 5/1962 | Canada . |
| 1103451 | 6/1981 | Canada . |
| 934001 | 8/1963 | United Kingdom . |

OTHER PUBLICATIONS

I Q Technologies, Inc. SC, 187 "Universal RS 232 Smart Cable" 1-3, 1983.

*Primary Examiner*—Ulysses Weldon
*Attorney, Agent, or Firm*—Seed and Berry

[57] ABSTRACT

A display element designed to permit easy assembly of an electronic display device and which utilizes an electromagnet having an L-shaped pole piece and reverse windings. Specifically, the invention resides in a display element for use in an information display device having a plurality of holes provided therein for receiving a plurality of the display elements. The display element includes a translucent member adapted to abut against the back side of the display device and cover one of the holes therein; a mounting bracket adapted to abut against the front side of the panel and having a fastening means extending through the hole of the display panel and connecting to the translucent member for securing the translucent member and the bracket to the panel; a flap pivotably secured to the display panel about a pivot axis, one side of the flap having a non-reflective surface and the other side of the flap having a reflective surface, the flap being piovtal from a first position where the non-reflective surface faces outwardly towards a viewer to a second position, approximately 180° from the first position, where the reflective surface faces outwardly towards a viewer; a magnet disposed on the flap; an electromagnet secured to the back side of the display device and having a pole piece disposed axially therein and extending into the translucent member; and a source for supplying electric current to the electromagnet so as to alternatively energize the pole piece to be a south pole piece or a north pole piece wherein when the pole pieces are energized to be either a north pole piece or a south pole piece the flap is pivoted to the first position and when the pole pieces are energized to be the other of the north pole piece and the south pole piece the flap is pivoted to the second position.

16 Claims, 2 Drawing Sheets

U.S. PATENT DOCUMENTS

| | | | |
|---|---|---|---|
| 3,562,938 | 2/1971 | Salam | 40/28 |
| 3,624,941 | 12/1971 | Chantry | 40/52 |
| 3,724,110 | 4/1973 | Meyerson | 40/28 |
| 3,745,563 | 7/1973 | Jones et al. | 340/378 |
| 3,825,927 | 7/1974 | Passien | 340/373 |
| 3,942,274 | 3/1976 | Winrow | 40/28 |
| 3,990,165 | 11/1976 | Vogt | 40/28 |
| 3,991,496 | 11/1976 | Helwig et al. | 40/28 |
| 3,995,386 | 12/1976 | Salam | 40/28 |
| 4,015,255 | 3/1977 | Wood | 340/373 |
| 4,040,193 | 8/1977 | Matsuda et al. | 40/28 |
| 4,070,668 | 1/1978 | Kawaharada et al. | 340/373 |
| 4,115,936 | 9/1978 | Nidelkoff | 40/449 |
| 4,161,832 | 7/1979 | Bergamini | 40/451 |
| 4,163,332 | 8/1979 | Salam . | |
| 4,215,338 | 7/1980 | Selig | 340/373 |
| 4,259,801 | 4/1981 | Ito | 40/449 |
| 4,308,528 | 12/1981 | Hummel et al. | 340/373 |
| 4,318,098 | 3/1982 | McGreevy | 340/764 |
| 4,327,357 | 4/1982 | Skrobisch | 340/373 |
| 4,410,888 | 10/1983 | Selig | 340/815 |
| 4,466,207 | 8/1984 | Salam | 40/449 |
| 4,539,768 | 9/1985 | Halliday | 40/447 |
| 4,578,533 | 3/1986 | Pierce | 179/2 |
| 4,587,753 | 5/1986 | Harper | 40/450 X |
| 4,627,182 | 12/1986 | Weiss | 40/447 |
| 4,694,599 | 9/1987 | Hart et al. | 340/764 X |
| 4,819,357 | 4/1989 | Salam | 40/449 |
| 4,983,956 | 1/1991 | Salam | 340/783 |

ELECTRONIC DISPLAY ELEMENT FOR ELECTRONIC DISPLAY DEVICE

TECHNICAL FIELD

This invention relates to an electronic display element, and more particularly, to an electronic display element, a plurality of which are used in an electronic display device.

BACKGROUND OF THE INVENTION

Electronic display elements for use in an electronic display device are known in the art. U.S. Pat. No. 4,163,332 discloses an information display device, including a plurality of electronic display elements which are arranged in horizontal and vertical rows. Each of the display elements includes an opaque sheet having an aperture provided therein and having an associated flap which is pivotable from a first position covering the aperture to a second position uncovering the aperture. The side of the flap which faces an observer when the aperture is covered is a non-reflective surface. The other side of the flap which faces an observer when the flap is uncovered is a highly reflective surface. Accordingly, when the flap is open, light is emitted through the aperture towards the observer and is reflected towards the observer off the reflective surface of the flap. In contrast, when the flap is closed, the low reflective surface of the flap faces the observer. The flap is actuated by utilizing a permanent magnet secured to the flap and a U-shaped electromagnet. Accordingly, U.S. Pat. No. 4,163,332 discloses an electronic display element utilizing a flip-flop type flap. However, the '332 patent does not disclose a display element that can be easily assembled to or disassembled from an electronic display device. Moreover, the electronic display element disclosed in the '332 patent utilizes a U-shaped electromagnetic having a single coil wrapped therearound. Accordingly, in order to change the polarity of the magnet it is necessary to reverse the direction of the current flow through the coil.

SUMMARY OF THE INVENTION

The present invention resides in a display element which is designed to permit easy assembly of the display device and which utilizes an electromagnet having an L-shaped pole piece and reverse windings. Specifically, the invention resides in a display element for use in an information display device having a plurality of holes provided therein for receiving a plurality of the display elements. The display element comprises a translucent member adapted to abut against the back side of the display device and cover one of the holes therein; a mounting bracket adapted to abut against the front side of the panel and having a fastening means extending through the hole of the display panel and connecting to the translucent member for securing the translucent member to the panel; a flap pivotally secured to the display panel about a pivot axis, one side of the flap having a non-reflective surface and the other side of the flap having a reflective surface, the flap being pivotal from a first position where the non-reflective surface faces outwardly towards a viewer to a second position, approximately 180° from the first position, where the reflective surface faces outwardly towards a viewer; a magnet disposed on the flap; an electromagnet secured to the back side of the display device and having a pole piece disposed axially therein and extending into the translucent member; and a power source for supplying electric current to the electromagnet so as to alternatively energize the pole piece to be a south pole piece or a north pole piece wherein when the pole pieces are energized to be either a north pole piece or a south pole piece the flap is pivoted to the first position and when the pole pieces are energized to be the other of the north pole piece and the south pole piece the flap is pivoted to the second position.

The pole piece is substantially L-shaped, one leg of the pole piece extending axially through the electromagnet and the other leg of the pole piece extending into the translucent member in a direction parallel with respect thereto. The leg which extends into the translucent member has a predetermined length and is disposed perpendicularly to the pivot axis of the flap. The magnet is disposed on the flap such that in the first and second positions, the magnet is disposed adjacent the pole piece.

DETAILED DESCRIPTION OF THE INVENTION

Figure 1:
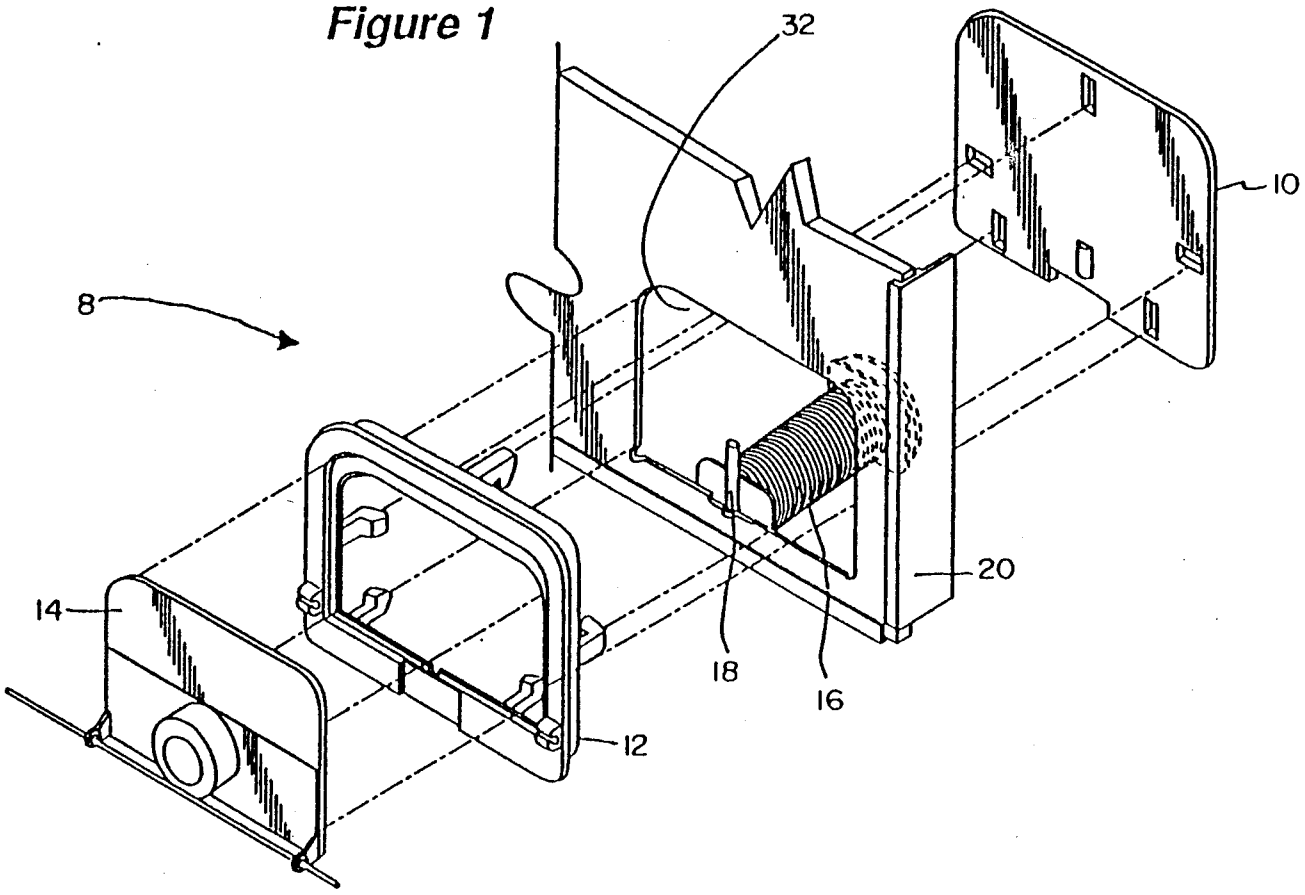
FIG. 1 is an exploded view of the electronic display element according to the present invention.

Referring to FIG. 1, the display element 8 includes a translucent member 10, bracket 12, flap 14, electromagnet 16, and pole piece 18. The display element is secured to a substrate 20 constituting a portion of the electronic display device. As shown in the figures, the display elements is secured to the substrate by snapping the bracket, positioned on the front of the substrate 20, to the translucent member, positioned on the back of the substrate. The flap is pivotally secured to the bracket about a horizontal axis so as to be pivotable from a first position covering the translucent member, illustrated in FIGS. 2 and 3, to a second position uncovering the translucent member, illustrated in FIGS. 4 and 5. The side 13 of the flap that is exposed to view when the flap is in the first position is substantially non-reflective while the other side 15 which is exposed to view when the flap is in the second position is highly reflective. Accordingly, by pivoting the flap from the first position to the second position the display element can be activated to emit and reflect light, as will be described in detail below.

Figure 2:
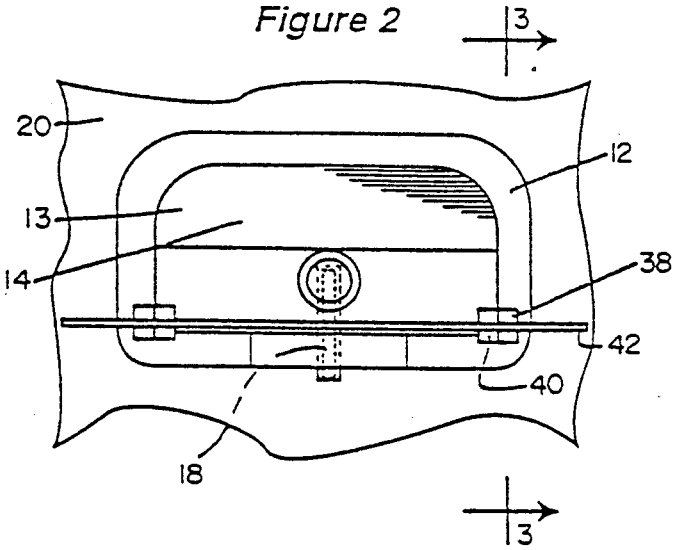
FIG. 2 is a front view of the display element with the flap in the closed position.
Figure 3:
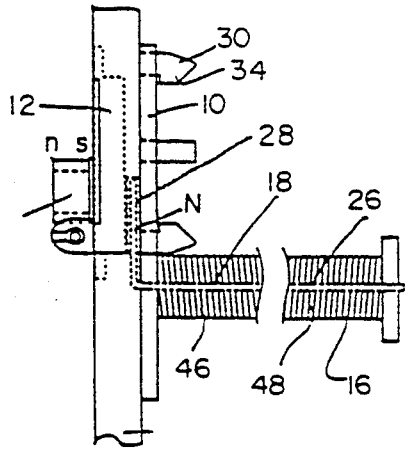
FIG. 3 is a side view of the display element with the flap in the closed position.
Figure 4:
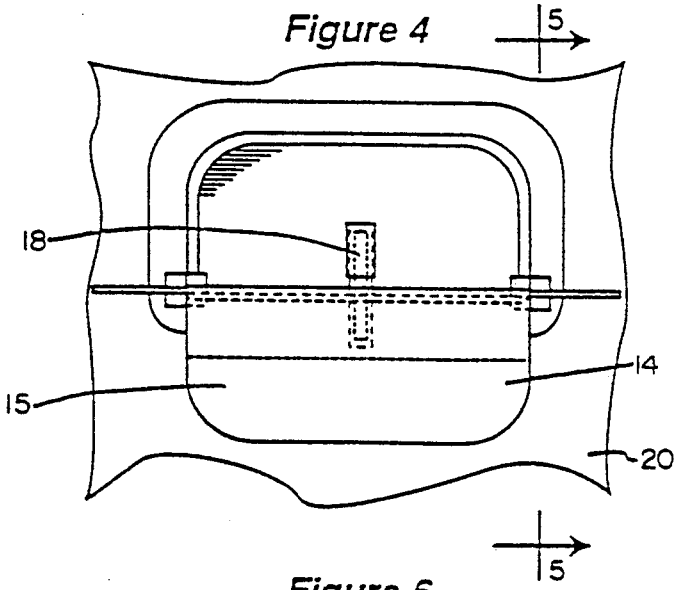
FIG. 4 is a front view of the display element with the flap in the opened position.
Figure 5:
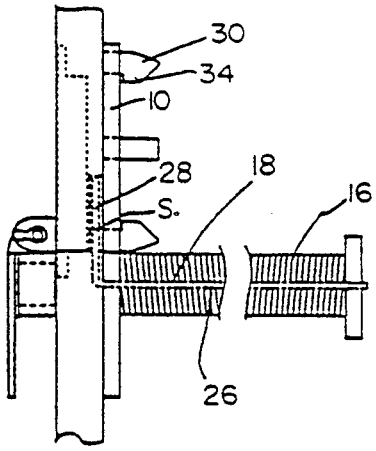
FIG. 5 is a side view of the display element with the flap in the opened position.

Referring to FIGS. 2–6, the construction of the display element is as follows. The electromagnet 16 protrudes outwardly from the back 22 of the substrate 20 and is secured thereto. The pole piece 18 is substantially L-shaped, including an axial leg 26 disposed axially in the electromagnet and a radial leg 28 which extends into the side of the translucent member 10. The translucent member 10 is abutted against the back of the panel and secured in that position by means of the bracket 12. More specifically, as illustrated in the figures, the bracket 12 is substantially rectangular in shape and has an opening in the center portion thereof. The bracket is disposed on the front of the substrate and includes a plurality of legs 30 which protrude from the bracket and extend through the aperture 32 of the substrate 20. Each of the legs has an L-shaped lip 34 which protrudes perpendicular therefrom. The legs 30 are respectively inserted into a plurality of holes 36 provided in the translucent member 10 in such a manner that the lips of each of the legs act to secure the bracket and the translucent member to the substrate, as illustrated in FIGS. 3 and 5. Accordingly, the translucent member and the bracket can quickly and easily be secured to the substrate.

Referring to FIG. 2, the bracket 12 has a pair of hinges 38 extending therefrom in the direction of the front 23 of the substrate 20. Correspondingly, the flap 14 also includes a pair of hinges 40 which extend therefrom. A pivot rod 42 extends through the hinges 38, 40 of the bracket 12 and flap 14, respectively, thereby pivotally securing the flap to the bracket such that the flap can pivot from the first position to the second position, as described above. As illustrated in FIGS. 2–5, the flap 14 has a magnet 44 secured thereto. The positioning of the magnet on the flap and the corresponding position of the pole piece 18 are important for proper functioning of the device. As illustrated in FIGS. 2–5, the radial leg 28 of the pole piece extends perpendicularly to the pivot rod 42. The magnet is disposed on the flap at a predetermined distance from the axis of rotation of the flap. Correspondingly, the length and positioning of the radial position of the pole piece is designed to insure that a portion of the pole piece is adjacent the center of the magnet when the flap is in both the closed position (FIG. 3) and the opened position (FIG. 5). In this manner, energization of the electromagnet will cause the flap to pivot from the first position to the second position, and vice versa.

Figure 6:
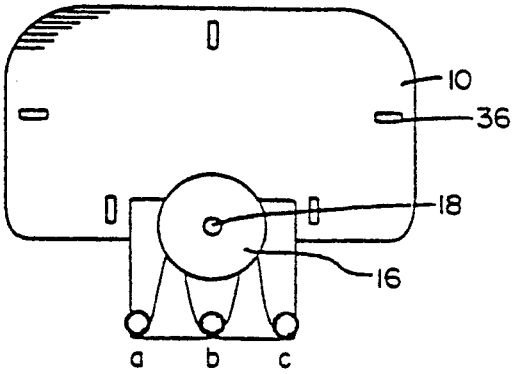
FIG. 6 is a rear view of the display element according to the present invention.

Referring to FIGS. 3, 5, and 6, the electromagnet 16 has a pair of coils 46, 48, respectively, wound in opposite directions therearound. Thus, electricity is supplied to node b (FIG. 6) flows through one of the two coils 46, 48 and returns to either node a or node 6. In this manner, the pole piece is energized to act either as a south pole piece or a north pole piece, depending upon which coil is energized.

The following is a description of the operation of the display element. As illustrated in FIG. 3, the magnet is secured to the flap 14 with either the south pole or the north pole disposed adjacent the flap. For purpose of description, we will assume that the south pole of the magnet is adjacent the flap as illustrated in FIG. 3. In this condition, the electricity is supplied to the appropriate coil 46 of the electromagnet 16 so that the pole piece 18 is energized to be a north pole piece thereby attracting the magnet 44 and retaining the flap in the closed position. In the closed position, the non-reflective surface 13 of the flap 14 faces the viewer such that the display element does not emit or reflect any light. To open the flap and thereby emit and reflect light, the other coil 48 is energized so as to convert the pole piece from a north pole piece to a south pole piece. In this case, as illustrated in FIG. 5, the flap 14 is pivoted 180° from the closed positions such that the north pole of the magnet is adjacent the pole piece, thereby maintaining the flap in the open position. In this position, a light which radiated from behind the display element is emitted through the translucent member 10 such that the translucent member emits light in the direction of the viewer. Additionally, the reflective surface 15 of the flap 14 faces in the direction of the viewer to thereby reflect light in the direction of the viewer.

The display element is assembled in the following manner. First, with the electromagnet 16 soldered to the back of the substrate 20 and having the pole piece 18 extending therefrom, the translucent member 10 is positioned on the back 22 of the substrate 20 such that the radial leg 28 of the pole piece is disposed therein. Thereafter, the bracket 12, disposed on the front side 23 of the substrate 20, is secured to the translucent member 10 by inserting the legs 30 into the holes 36 of the translucent member. In this manner, the translucent member 10 and the bracket 12 are secured to the substrate 20. Thereafter, the flapper is secured to the bracket by inserting the axial rod 42 through the hinges 38, 40 of the bracket and the flap, respectively. Thus, according to the invention, the display element can be quickly and easily assembled, thereby minimizing manufacturing costs.

We claim:

1. A display element for use in an information display device having a plurality of holes provided therein for receiving a plurality of said display elements, said display element comprising:

a translucent member adapted to abut against a back side of said display device and cover one of said holes;

a mounting bracket adapted to abut against a front side of said display device, said bracket having fastening means extending through said one hole of said display device and connecting to said translucent member for securing said translucent member to said display device;

a flap pivotally secured to said bracket about a pivot axis, one side of said flap having a non-reflective surface and the other side of said flap having a reflective surface, said flap being pivotable from a first position where said non-reflective surface faces outwardly therefrom to a second position, approximately 180° from said first position, where said reflective surface faces outwardly therefrom;

a magnet disposed on said flap;

an electromagnet secured to said back side of said display device, said electromagnet having a pole piece disposed axially therein and extending into said translucent member; and means for supplying an electric current to said electromagnet so as to alternatively energize said pole piece to be a south pole piece or a north pole piece;

wherein when said pole piece is energized to be one of a north pole piece and a south pole piece said flap is pivoted to said first position and when said pole piece is energized to be the other of said north pole piece and south pole piece said flap is pivoted to said second position.

2. The display element of claim 1 wherein said electromagnet includes a pair of coils wound in opposite directions from one another, wherein electric current is supplied to one of said coils to energize said pole piece to be a south pole piece and electric current is supplied to the other side of said coils to energize said pole piece to be a north pole piece.

3. The display element of claim 1 wherein said pole piece is L-shaped.

4. The display element of claim 3 wherein a leg of said L-shaped pole piece extends into said translucent member in a direction parallel with respect thereto and wherein said magnet is positioned on said flap in such a manner that said magnet is adjacent said pole piece in both said first position and said second position.

5. The display element of claim 4 wherein said magnet is disposed on said flap adjacent said pivot axis.

6. The display element of claim 4 wherein said magnet is disposed on said flap such that the center thereof is a predetermined distance from said pivot axis and wherein the length of said leg of said pole piece is twice as long as said predetermined distance.

7. The display element of claim 1 wherein fastening means comprises a plurality of legs which are received in corresponding holes provided in said translucent member.

8. A method of manufacturing an information display device having a substrate with a plurality of holes provided therein for receiving a plurality of display elements, comprising the following steps for each display element:

securing an electromagnet to the back of a substrate adjacent one of said holes, said electromagnet having a pole piece protruding therefrom;

abutting a translucent member to a back of said substrate so as to cover said one hole;

inserting said pole piece into said translucent member such that said pole piece extends parallel to said translucent member;

abutting a bracket against a front of said substrate at said one hole, said bracket having an opening in the center portion thereof such that said translucent member can be seen through said opening;

fastening said bracket disposed on said front of said substrate to said translucent member disposed on said back of said substrate; and pivotally mounting a flap to said bracket such that said flap is pivotal from a first position covering said opening and said translucent member, to a second position uncovering said opening and said translucent member, said flap having a substantially non-reflective surface on a side thereof which faces outwardly when in said first position and a reflective surface on the opposite side which faces outwardly when in said second position.

9. The method of claim 8 wherein said step of fastening said bracket on said front side of said substrate comprises inserting a plurality of legs extending from said bracket into a plurality of leg receiving holes provided in said translucent member, said legs having fastening means which engage and hold said translucent member in position at said back of said substrate.

10. A display element for use in an information display device having a plurality of holes provided therein for receiving a plurality of said display elements, said display element comprising:

a translucent member adapted to be positioned at a first side of said display device and cover one of said holes;

a mounting bracket adapted to be positioned at a second side of said display device and having fasteners extendable through said one hole of said display device to connect to said translucent member for securing said translucent member to said display device;

a flap pivotally secured to said bracket about a pivot axis, one side of said flap having a non-reflective surface and the other side of said flap having a reflective surface, said flap being pivotable from a first position where said non-reflective surfaces faces outwardly therefrom to a second position where said reflective surface faces outwardly therefrom;

a magnet disposed on said flap;

an electromagnet secured to said first side of said display device, said electromagnet having a pole piece extending to said translucent member; and conductors which supply an electric current to said electromagnet so as to alternatively energize said pole piece to be a south pole piece or a north pole piece;

wherein when said pole piece is energized to be one of a north pole piece and a south pole piece said flap is pivoted to said first position and when said pole piece is energized to be the other of said north piece and south pole piece said flap is pivoted to said second position.

11. The display element of claim 10 wherein said electromagnet includes a pair of coils wound in opposite directions from one another, wherein electric current is supplied to one of said coils to energize said pole piece to be a south pole piece and electric current is supplied to the other side of said coils to energize said pole piece to be a north pole piece.

12. The display element of claim 10 wherein said pole piece is L-shaped.

13. The display element of claim 12 wherein a leg of said L-shaped pole piece extends in a direction parallel to said translucent member and wherein said magnet is positioned on said flap in such a manner that said magnet is adjacent said pole piece in both said first position and said second position.

14. The display element of claim 13 wherein said magnet is disposed on said flap adjacent said pivot axis.

15. The display element of claim 13 wherein said magnet is disposed on said flap such that the center thereof is a predetermined distance from said pivot axis and wherein the length of said leg of said pole piece is twice as long as said predetermined distance.

16. The display element of claim 10 wherein fasteners comprise a plurality of legs which are received in corresponding hole provided in said translucent member.

* * * * *

UNITED STATES PATENT AND TRADEMARK OFFICE

CERTIFICATE OF CORRECTION

PATENT NO. : 5,111,193

DATED : May 5, 1992

INVENTOR(S) : Terrence D. Huber et al.

It is certified that error appears in the above-identified patent and that said Letters Patent is hereby corrected as shown below:

In column 6, claim 10, line 14, please delete "surfaces" and substitute therefor -- surface --.

In column 6, claim 10, line 29, after "north" please insert -- pole --.

Signed and Sealed this

Sixth Day of July, 1993

*Attest:*

Michael K. Kirk

MICHAEL K. KIRK

*Attesting Officer*

*Acting Commissioner of Patents and Trademarks*